US009237782B2

(12) United States Patent
Ren

(10) Patent No.: US 9,237,782 B2
(45) Date of Patent: Jan. 19, 2016

(54) SLIDE FASTENER

(75) Inventor: Zhiyu Ren, Toyama (JP)

(73) Assignee: YKK Corporation (JP)

( * ) Notice: Subject to any disclaimer, the term of this patent is extended or adjusted under 35 U.S.C. 154(b) by 190 days.

(21) Appl. No.: 13/824,424

(22) PCT Filed: Sep. 28, 2010

(86) PCT No.: PCT/JP2010/066868

§ 371 (c)(1),
(2), (4) Date: Mar. 18, 2013

(87) PCT Pub. No.: WO2012/042601

PCT Pub. Date: Apr. 5, 2012

(65) Prior Publication Data

US 2013/0174388 A1 Jul. 11, 2013

(51) Int. Cl.

| | |
|---|---|
| ***A44B 19/26*** | (2006.01) |
| ***A44B 19/14*** | (2006.01) |
| ***A44B 19/10*** | (2006.01) |
| ***A44B 19/04*** | (2006.01) |
| ***A44B 19/34*** | (2006.01) |
| ***A44B 19/40*** | (2006.01) |

(52) U.S. Cl.

CPC ..... *A44B 19/26* (2013.01); *A44B 19/04* (2013.01); *A44B 19/346* (2013.01); *A44B 19/403* (2013.01); *Y10T 24/2536* (2015.01); *Y10T 24/2548* (2015.01); *Y10T 24/2582* (2015.01)

(58) Field of Classification Search

CPC .... A44B 19/403; A44B 19/26; A44B 19/346; A44B 19/04; Y10T 24/2582

USPC ..... 24/381, 401, 408

See application file for complete search history.

(56) References Cited

U.S. PATENT DOCUMENTS

| | | | | |
|---|---|---|---|---|
| 4,250,598 | A * | 2/1981 | Moertel | 24/408 |
| 4,290,175 | A * | 9/1981 | Moertel | 24/408 |
| 4,290,176 | A * | 9/1981 | Wulz | 24/408 |
| 4,291,440 | A * | 9/1981 | Yoshida | 24/408 |

(Continued)

FOREIGN PATENT DOCUMENTS

| | | | |
|---|---|---|---|
| EP | 92130 | A2 | 10/1983 |
| JP | 56-89204 | A | 7/1981 |

(Continued)

OTHER PUBLICATIONS

International Preliminary Report on Patentability, PCT Application No. PCT/JP2010/066868, mailed Apr. 16, 2013.

(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

The slide fastener includes a pair of fastener tapes, a pair of fastener element rows respectively including a plurality of fastener elements and coupling yarns coupling the plurality of fastener elements, and a slider configured to engage and disengage the pair of fastener element rows. Each of the fastener elements includes a body portion, a neck portion, an engaging head, portion and a pair of shoulder portions provided at both sides of the neck portion in the tape longitudinal direction and configured to come in contact with opposite engaging head portions. The pair of fastener tapes have stretchability in the tape longitudinal direction.

4 Claims, 7 Drawing Sheets

(56) References Cited

U.S. PATENT DOCUMENTS

| | | | | | |
|---|---|---|---|---|---|
| 4,297,770 | A | * | 11/1981 | Wulz | 24/408 |
| 4,313,244 | A | * | 2/1982 | Authier | 24/408 |
| 4,331,493 | A | * | 5/1982 | Lawrence | 156/66 |
| RE30,951 | E | * | 6/1982 | Cuckson et al. | 24/408 |
| 4,418,449 | A | | 12/1983 | Heimberger et al. | |
| 4,488,338 | A | * | 12/1984 | Takahashi | 24/389 |
| 4,675,951 | A | * | 6/1987 | Hasegawa | 24/408 |
| 4,891,867 | A | * | 1/1990 | Takeshima et al. | 24/408 |
| 4,924,560 | A | | 5/1990 | Matsuda et al. | |
| 5,297,319 | A | * | 3/1994 | Akashi et al. | 24/405 |
| 2008/0209694 | A1 | | 9/2008 | Horikawa et al. | |
| 2010/0107374 | A1 | | 5/2010 | Nakayama et al. | |
| 2013/0133161 | A1 | * | 5/2013 | Ren | 24/434 |

FOREIGN PATENT DOCUMENTS

| | | | |
|---|---|---|---|
| JP | 63-294804 | A | 12/1988 |
| JP | 2008-43432 | A | 2/2008 |
| JP | 2010-104685 | A | 5/2010 |
| TW | 201026249 | A | 7/2010 |
| WO | 2012-020499 | A1 | 2/2012 |

OTHER PUBLICATIONS

International Search Report, PCT Application No. PCT/JP2010/066868, mailed Dec. 28, 2010.

Office Action, Chinese Patent Application No. 201080070361.3, mailed Dec. 22, 2014.

* cited by examiner

SLIDE FASTENER

This application is a national stage application of PCT/JP2010/066868 which is incorporated herein by reference.

TECHNICAL FIELD

The present invention relates to a slide fastener, and more particularly, to a slide fastener suitable for garments having strechability such as sportswear or swimming suit.

BACKGROUND ART

Slide fasteners are recently used for garments having strechability (hereinafter, referred to as stretchable garments) such as sportswear or swimming suit, as well as general garments such as fashion garments or underwear. The slide fastener for use in the stretchable garments is required to have the strechability, like the stretchable garment.

As a slide fastener having the strechability in the related art, there is known a slide fastener in which coil-shaped fastener element rows are sewn along tape-side edge portions of fastener tapes having the strechability (e.g., see Patent Document 1).

PRIOR ART DOCUMENT

Patent Document

Patent Document 1: Japanese Patent Application Publication No. 2008-043432A

SUMMARY OF INVENTION

Problems to be Solved by Invention

In the slide fastener disclosed in Patent Document 1, however, since each engaging head of the coil-shaped fastener element rows is formed by press when molding, there is a limitation in forming to ensure a desired shape, such as a size of the engaging head. Due to this limitation, if the slide fastener is attached to garments having higher strechability, engagement strength of the fastener elements becomes insufficient depending upon a stretchable degree thereof, so that there is a possibility that the engaging state is not maintained.

The present invention has been made in view of the above-described problem, and an object of the present invention is to provide a slide fastener capable of ensuring engagement strength of fastener elements even though the slide fastener is attached to highly-stretchable garments.

Means for Solving Problems

The above object of the present invention can be achieved by the following configuration.

(1) A slide fastener including: a pair of fastener tapes; a pair of fastener element rows respectively including a plurality of fastener elements arranged in a tape longitudinal direction along opposing tape-side edge portions of the pair of fastener tapes, and coupling yarns coupling the plurality of fastener elements which are adjacent to each other in the tape longitudinal direction, the fastener element rows respectively sewn to the tape-side edge portions; and a slider configured to engage and disengage the pair of fastener element rows, wherein each of the fastener elements includes: a body portion sewn to the fastener tape; a neck portion extending from the body portion in a tape width direction and in a direction toward an opposite fastener tape, and constricted in the tape longitudinal direction; an engaging head portion further extending from a tip end portion of the neck portion in the tape width direction and in a direction toward the opposite fastener tape and swelling up in the tape longitudinal direction, the engaging head portion being engageable with opposite fastener elements; and a pair of shoulder portions which are provided at both sides of the neck portion in the tape longitudinal direction, and configured to come in contact with opposite engaging head portions in an engaging state, and wherein the pair of fastener tapes have stretchability in the tape longitudinal direction.

(2) The slide fastener according to (1), wherein a dimension of the engaging head portion in the tape longitudinal direction is set to be larger than a dimension between tip end portions of the pair of shoulder portions in the tape longitudinal direction.

(3) The slide fastener according to (1) or (2), wherein each of the fastener elements includes a first surface portion which is in contact with the fastener tape, and a second surface portion which is disposed at an opposite side of the first surface portion, wherein the first surface portion has the body portion, the neck portion, and the engaging head portion, and the second surface portion has the body portion, the pair of shoulder portions, and a head portion extending from the body portion in the tape width direction and in a direction toward the opposite fastener tape, wherein a dimension of the head portion in the tape longitudinal direction is gradually decreased toward a tip end thereof.

(4) The slide fastener according to any one of (1) to (3), wherein the coupling yarns have stretchability.

(5) The slide fastener according to any one of (1) to (4), wherein the tip end portions of the pair of shoulder portions are disposed at a side of the engaging head portion relative to the body portion in the tape width direction.

Advantageous Effects of Invention

According to the slide fastener of the present invention, the fastener element has the body portion sewn to the fastener tape, the neck portion extending from the body portion in the tape width direction and in a direction toward the opposite fastener tape, and constricted in the tape longitudinal direction, the engaging head portion further extending from the tip end portion of the neck portion in the tape width direction and in a direction toward the opposite fastener tape and swelling up in the tape longitudinal direction, the engaging head portion being engageable with the opposite fastener elements, and the pair of shoulder portions provided at both sides of the neck portion in the tape longitudinal direction, and configured to come in contact with opposite engaging head portions in the engaging state. Further, the pair of fastener tapes have stretchability in the tape longitudinal direction. As a result, even though the slide fastener is attached to the high-stretchable garments, it is possible to ensure the engaging strength of the fastener elements, thereby maintaining the engaging state of the pair of fastener elements.

EMBODIMENTS OF INVENTION

Each embodiment of a slide fastener according to the present invention will now be described in detail with reference to the accompanying drawings. In the following description, as for a fastener tape, an obverse side refers to a near side with respect to the paper surface of FIG. 1 (i.e., an upper side of a slider on which a pull tab is provided, as will be described later), a reverse side refers to a far side with respect to the paper surface of FIG. 1 (i.e., a lower side of the slider, on which the pull tab is not provided, as will be described later), a front side refers to an upper side with respect to the paper surface of FIG. 1 (i.e., a side of a direction in which the slider moves to engage fastener element rows of the slide fastener, as will be described later), a rear side refers to a lower side with respect to the paper surface of FIG. 1 (i.e., a side of a direction in which the slider moves to disengage the fastener elements, as will be described later), a left side refers to a left side with respect to the paper surface of FIG. 1, and a right side refers to a right side with respect to the paper surface of FIG. 1. As for the slider, an upper side refers to a near side with respect to the paper surface of FIG. 1, a lower side refers to a far side with respect to the paper surface of FIG. 1, a front side refers to an upper side with respect to the paper surface of FIG. 1, a rear side refers to a lower side with respect to the paper surface of FIG. 1, a left side refers to a left side with respect to the paper surface of FIG. 1, and a right side refers to a right side with respect to the paper surface of FIG. 1. Herein, an obverse and reverse direction refers to a direction vertical to a surface of the fastener tape, and a right and left direction refers to a direction parallel with the surface of the fastener tape and perpendicular to a front and rear direction of the fastener tape. Further, a right and left direction of the fastener tape and the slider is also referred to as a width direction. Also, the front and rear direction of the fastener tape is also referred to as a longitudinal direction. A tape longitudinal direction refers to a longitudinal direction of the fastener tape and a tape width direction refers to the width direction of the fastener tape.

Further, in the present invention, strechability refers to a property of stretching when a load is applied and of shrinking when the load is released so as to return to a previous state before the load is applied.

Embodiment 1

The first embodiment of the slide fastener according to the present invention will now be described with reference to FIGS. 1 to 10.

Figure 1:
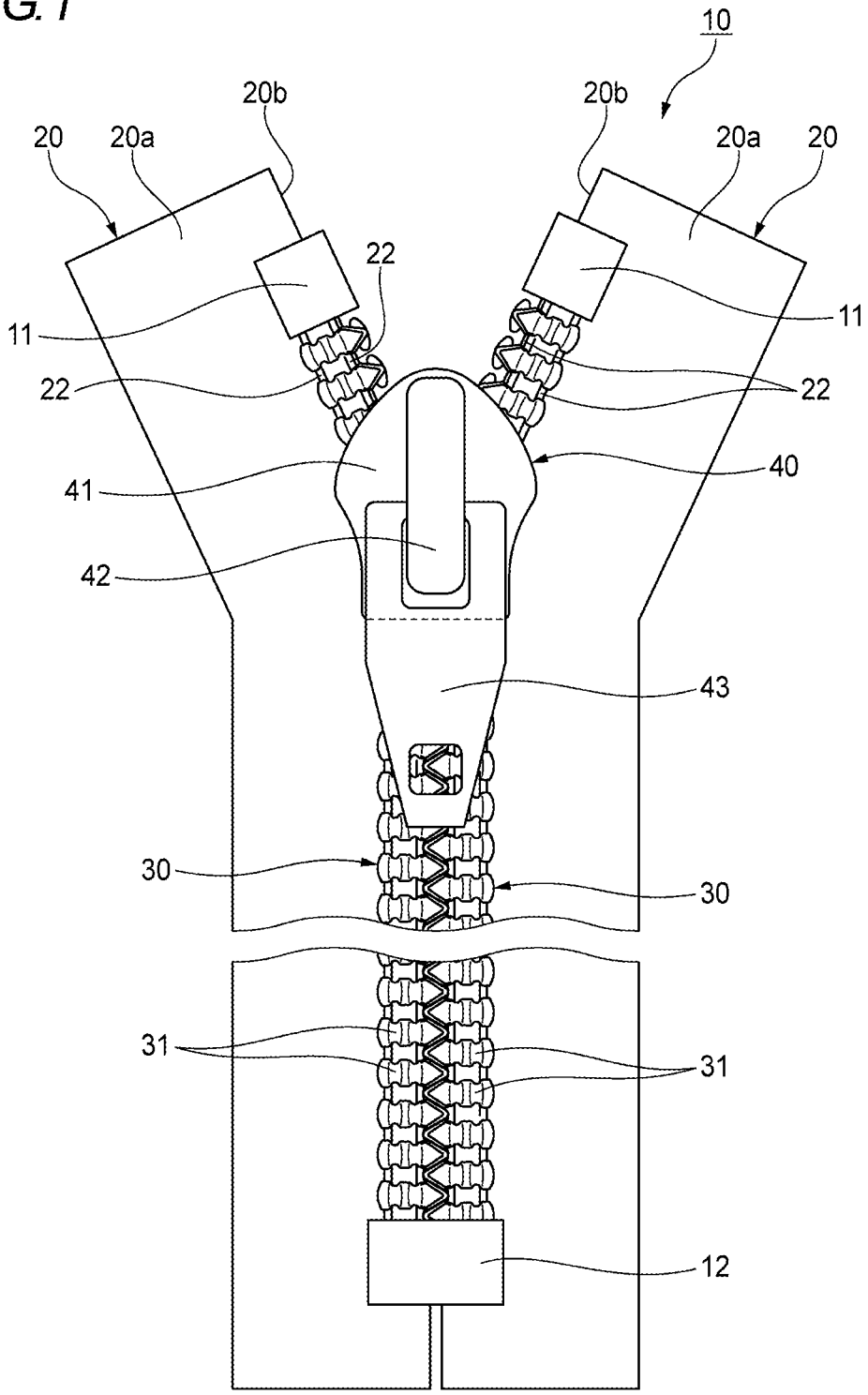
FIG. 1 is a front side view illustrating a slide fastener according to a first embodiment of the present invention.
Figure 2:
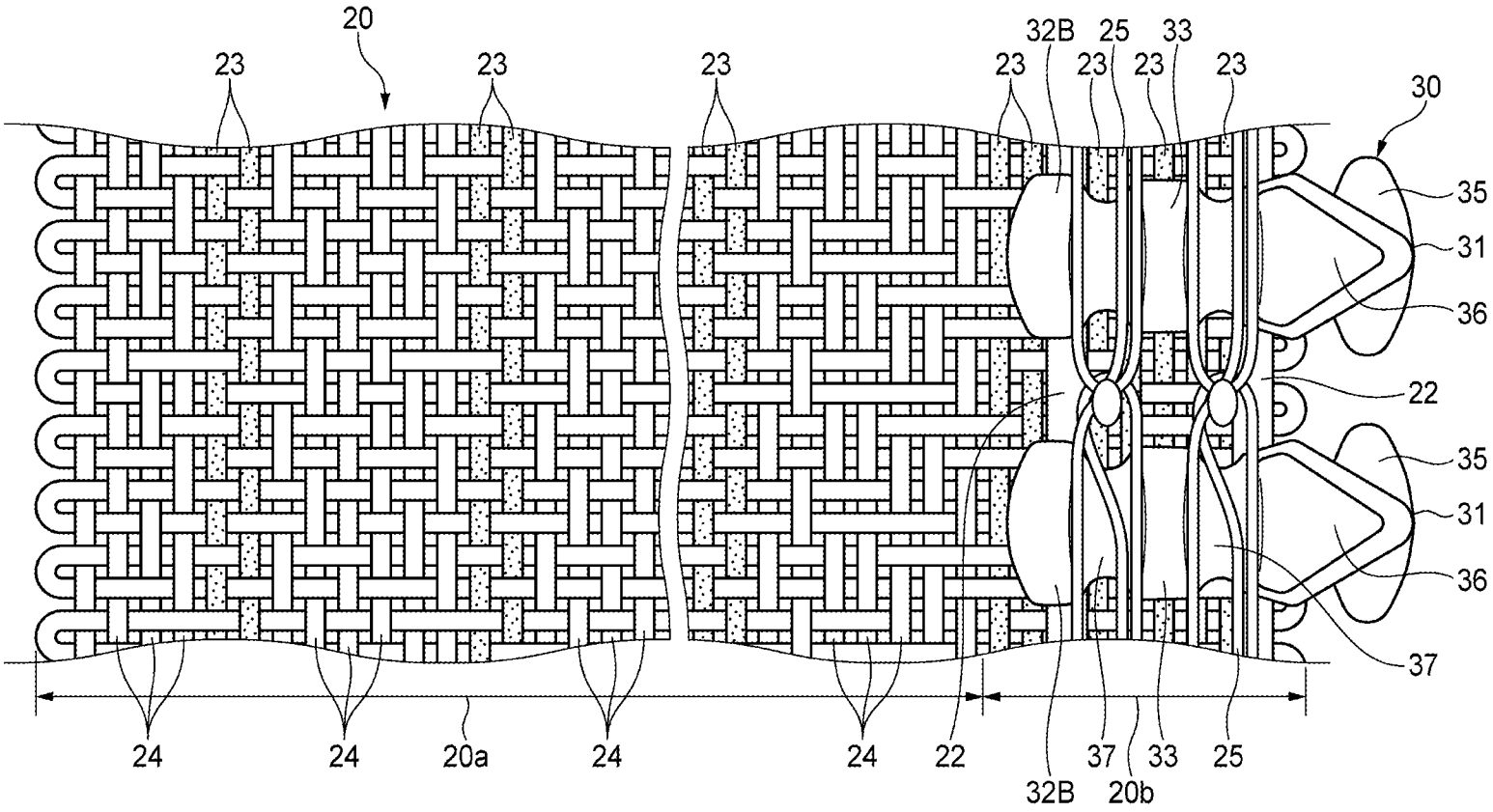
FIG. 2 is a diagram schematically illustrating a fabric structure of the fastener tape.

A slide fastener 10 of this embodiment includes, as illustrated in FIGS. 1 and 2, a pair of right and left fastener tapes 20 respectively having tape body portions 20*a* and tape-side edge portions 20*b* which are arranged in parallel and opposite to each other in the right and left direction, fastener element rows 30 respectively sewn to the opposing tape-side edge 20*b* and having a plurality of fastener elements 31, a slider 40 configured to engage and disengage the right and left fastener element rows 30, top end stops 11, 11 made by injection molding to respectively cover the fastener elements 31 at front side end portions of the right and left fastener element rows 30, and a bottom end stop 12 made by injection molding to cover both fastener elements 31 at rear side end portions of the right and left fastener element rows 30. In this instance, the bottom end stop 12 may be a separable end stop having an insert pin, a box pin, and a box body. In this instance, in FIGS. 1 and 3, sewing yarns 25 are not illustrated to show the respective components.

The fastener tape 20 is made by weaving, as illustrated in FIG. 2, and the tape body portion 20*a* and the tape-side edge portion 20*b* are woven in a certain combination of elastic yarns (stretchable yarns) 23 serving as warp yarns and non-elastic yarns (non-stretchable yarns) 24 serving as weft yarns. For this reason, the fastener tape 20 has the strechability in the tape longitudinal direction. The fastener tape 20 may be made by knitting, and, in this instance, knitting yarns (warp insertion yarns, chain stitch yarns, tricot stitch yarns or the like) in a warp direction should be stretchable yarns. Also, in this embodiment, the elastic yarns 23 are employed only as the warp yarns, but the elastic yarns 23 may also be employed as the weft yarn to stretch the fastener tape 20 in the width direction. Further, a lot of elastic yarns 23 are disposed at the tape-side edge portion 20*b* as compared to the tape body portion 20*a*, but the elastic yarns 23 may be disposed uniformly as a whole, or the whole warp yarns may employ the elastic yarns 23.

A Spandex covered yarn which is constituted by winding a polyester filament yarn around a polyurethane elastic yarn, a rubber yarn made of elastomer, or a covered yarn constituted by winding a spun yarn or filament around the rubber yarn is used for the elastic yarn 23. A polyester processed yarn is used for the non-elastic yarn 24. When the same load is applied to the elastic yarn 23 and the non-elastic yarn 24, the elastic yarn 23 is stretched more than the non-elastic yarn 24. Further, the elastic yarn 23 has the strechability capable of stretching 5% or more when the load of 1 kgf is applied, preferably stretching 10% or more when the load of 1 kfg is applied. If the higher strechability is needed, the slide fastener 10 is preferably stretched by 20%, and a yarn conforming to the desired strechability can be used.

In addition, the reverse surface of the fastener tape 20 may be provided with a waterproof layer using a film or coating. In this instance, the fastener elements 31 are used upside-down to prevent penetration of rainwater, thereby providing the slide fastener 10 with a waterproof performance. Since the waterproof layer is made of an elastomeric resin material (thermoplastic elastomer or the like), it does not interrupt the strechability of the fastener tape 20.

The fastener element row 30 is comprised of a plurality of elements 31 which are independent from each other and are arranged in one row along the longitudinal direction of the tape-side edge portion 20*b* of the fastener tape 20, and a pair of stretchable coupling yarns 22 which connect the fastener elements 31 adjacent to each other and are arranged in parallel with each other side by side in the width direction of the fastener tape 20. The plurality of fastener elements 31 are formed by injection molding using synthetic resin, for example, polyamide, polyacetal, polypropylene, or polybutylene terephthalate, on the pair of coupling yarns 22 at regular intervals. The pair of coupling yarns 22 are formed in the fastener elements 31 by insert molding. In this instance, the fastener elements 31 are not limited to the synthetic resin, but may be made of metal.

Figure 6:
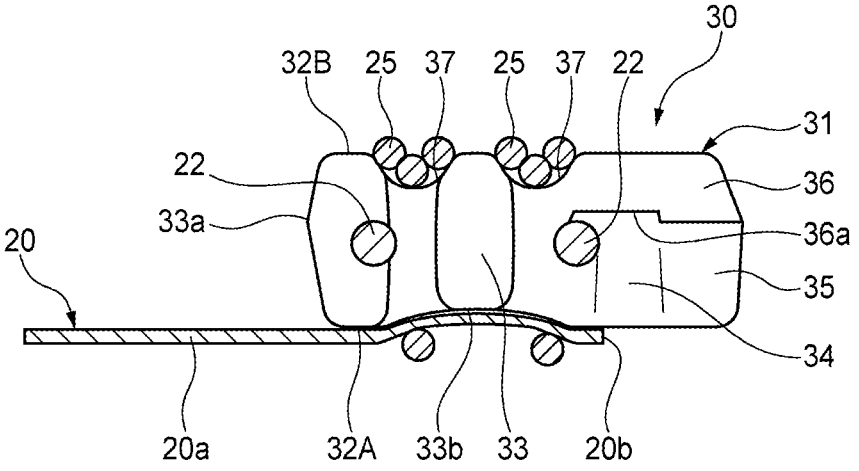
FIG. 6 is a cross-sectional view taken along the line A-A in FIG. 3.

As illustrated in FIGS. 2 and 6, the fastener element row 30 is attached to the fastener tape 20 by sewing the respective fastener elements 31 to the fastener tape 20 along the surface of the tape-side edge portion 20*b* of the fastener tape 20 using two sewing yarns 25 which are arranged side by side in the width direction of the fastener tape 20. Further, two sewing yarns 25 are double-chain stitched. After two sewing yarns 25 cross over the surfaces of the adjacent fastener elements 31 in the longitudinal direction of the fastener tape 20, the sewing yarns are sewn to the fastener tape 20 between the fastener elements 31. Therefore, ring-shaped sewing yarns 25 are disposed on the surfaces of the fastener elements 31, and the fastener elements 31 are sewn to the fastener tape 20. Three sewing yarns 25 may be used.

Each of the fastener elements 31 includes, as illustrated in FIGS. 3 to 7, a reverse-side portion 32A which is a first surface portion coming into contact with the fastener tape 20 and an obverse-side portion 32B which is a second surface portion positioned at an opposite side of the reverse-side portion 32A and disposed at the obverse side.

Figure 5:
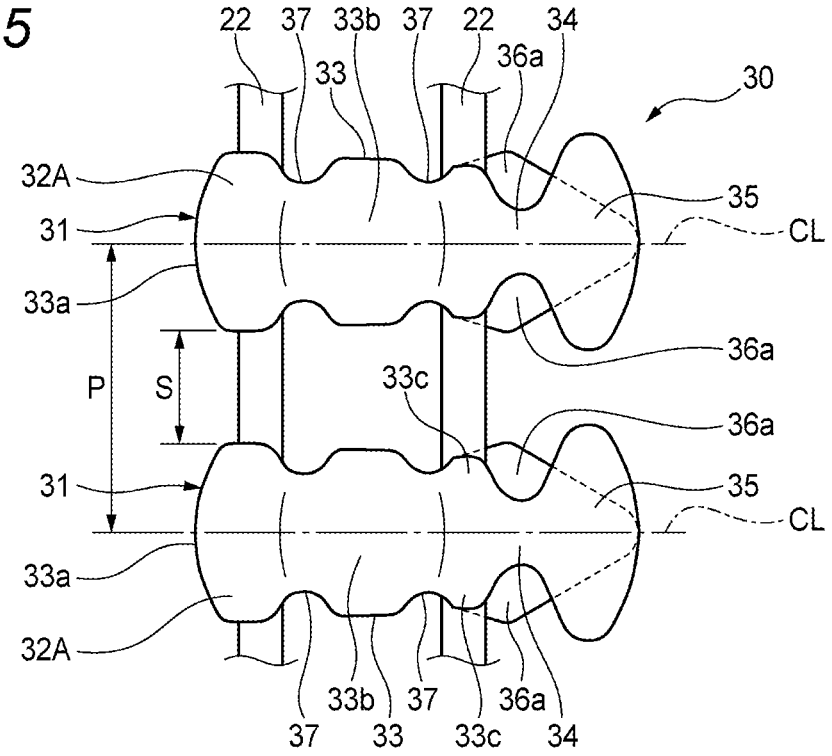
FIG. 5 is a rear side view of the fastener element row in FIG. 3.

The reverse-side portion 32A has, as illustrated in FIG. 5, a body portion 33 sewn to the fastener tape 20, a neck portion 34 extending from the body portion 33 in the tape width direction and in a direction toward the opposite fastener element 20 and constricted in the tape longitudinal direction, and an engaging head portion 35 further extending from a tip end portion of the neck portion 34 in the tape width direction and in a direction toward the opposite fastener tape 20 and swelling up in the tape longitudinal direction, the engaging head portion 35 being engageable with the opposite fastener elements 31. The engaging head portion 35 is engaged with the neck portion 34 of the adjacent fastener element 31 when the right and left fastener element rows 30 are engaged.

The body portion 33 is a cube of a substantially rectangular shape which is elongated in the width direction of the fastener tape 20 in a plan view, and an end face of the body portion 33, opposite to the engaging head portion 35 is formed with a protruding round surface 33*a* having a substantially spherical surface of which a center portion in the longitudinal direction and the obverse and reverse direction of the fastener tape 20 protrudes toward a side opposite to the engaging head portion 35. Accordingly, when the slider 40 is operated, since the protruding round surface 33*a* comes in sliding contact with the slider 40, a contact area between the slider 40 and the protruding round surface 33*a* becomes smaller than that of a flat surface. For this reason, since the sliding resistance generated when the slider 40 is moved is decreased, the slider 40 can be operated by small power.

Further, as illustrated in FIG. 6, a curved portion 33*b* which is concavely curved in a direction of the obverse-side portion 32B is formed on a reverse side of the body portion 33 between the pair of coupling yarns 22. Accordingly, since the fastener tape 20 is sewn to be in close contact with the curved portion 33*b* of the body portion 33, the attachment strength of the fastener elements 31 to the fastener tape 20 is increased.

Figure 3:
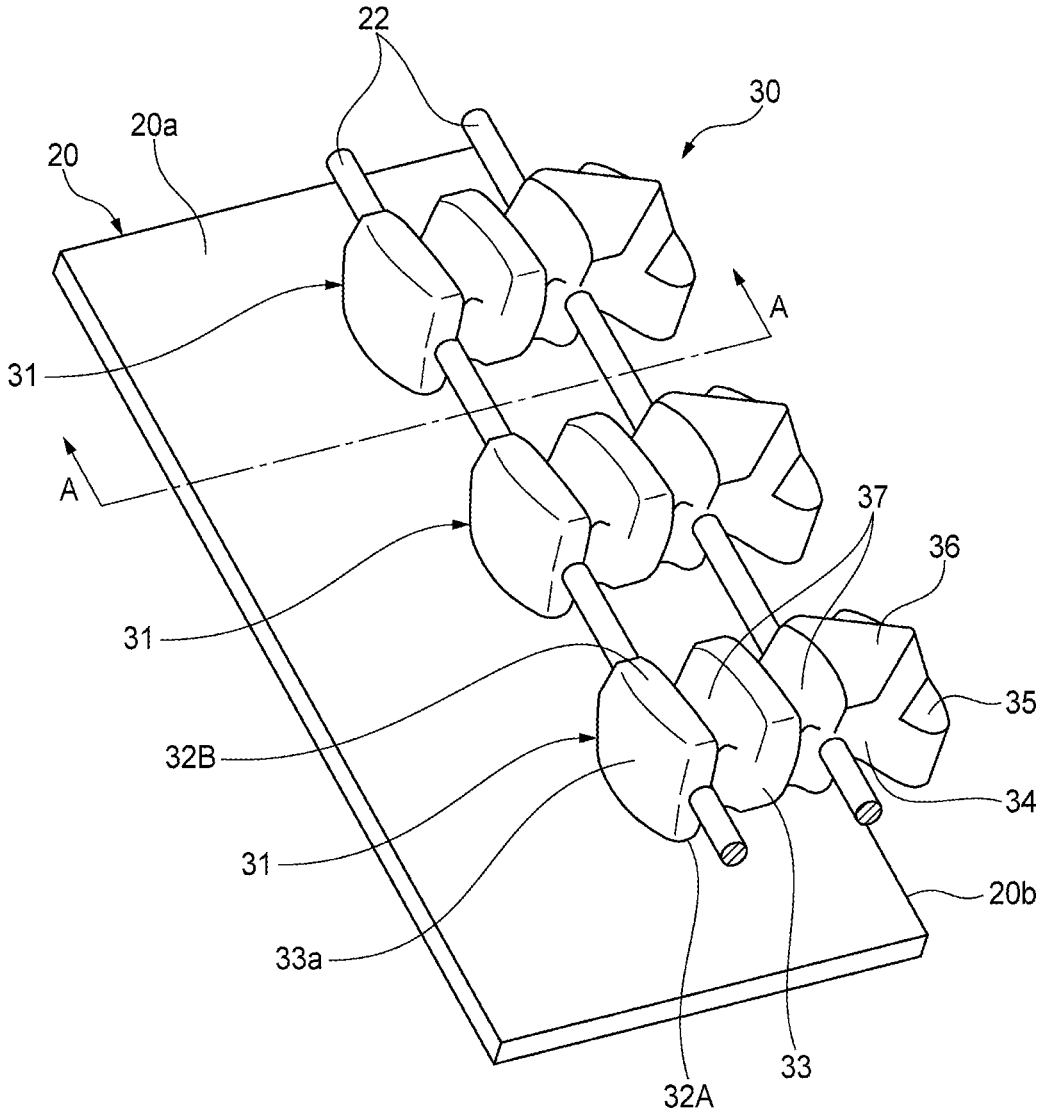
FIG. 3 is an enlarged perspective view illustrating a fastener element row in a non-engaged state.
Figure 4:
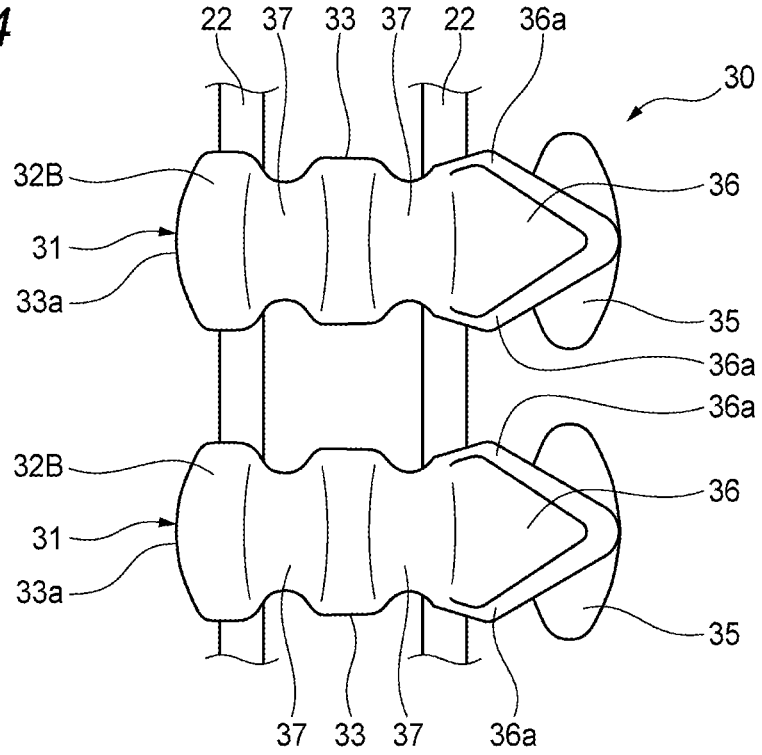
FIG. 4 is a front side view of the fastener element row in FIG. 3.

As illustrated in FIGS. 3 and 4, the obverse-side portion 32B has the body portion 33, an obverse-side head portion 36 having a substantially triangular shape in a plan view which extends from the body portion 33 in the tape width direction and in a direction toward the opposite fastener tape 20, of which a dimension in the tape longitudinal direction being gradually decreased toward a tip end thereof, and a pair of obverse-side shoulder portions 36*a* which are a portion of the obverse-side head portion 36, are provided at both sides of the neck portion 34 in the tape longitudinal direction, and are in contact with a top surface (obverse-side surface) of the opposite engaging head portion 35 in the engaging state. That is, the obverse-side head portion 36 is formed at an obverse side portion of the neck portion 34 and the engaging head portion 35 of the reverse-side portion 32A, and the pair of obverse-side shoulder portions 36*a* are formed at a position which is overlapped with the opposite engaging head portion 35 in a plan view.

Figure 7:
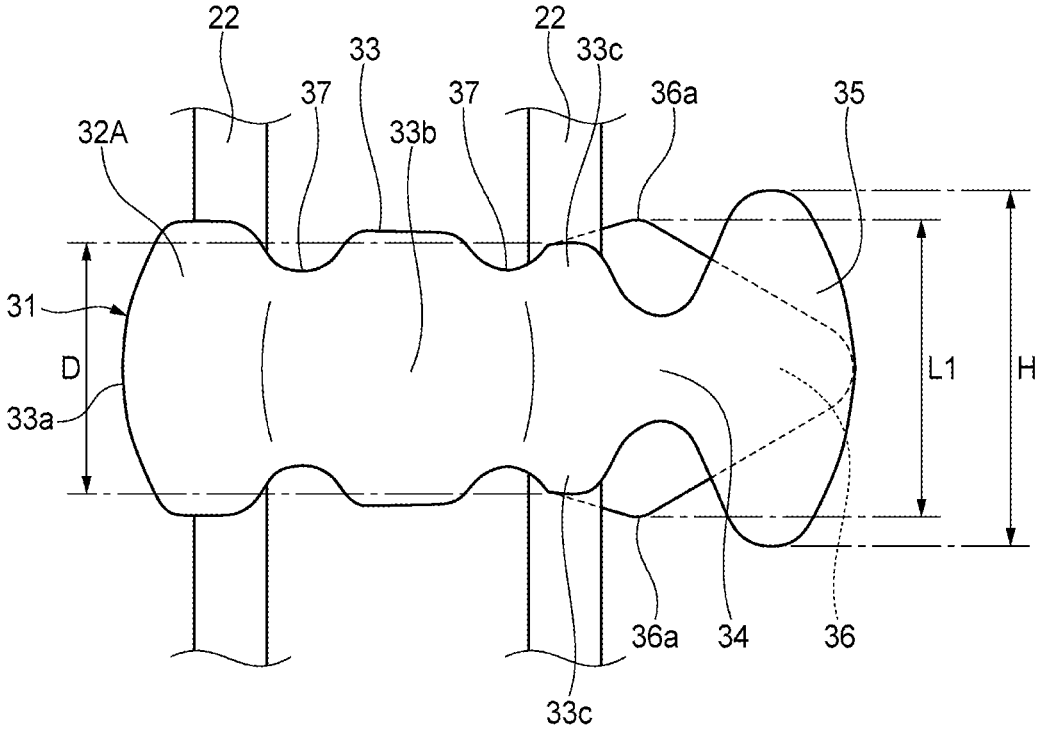
FIG. 7 is a rear side view of the fastener element.

Further, the end portion of the obverse-side shoulder portion 36*a* in the tape longitudinal direction at a side approaching the adjacent fastener element 31 refers to a tip end portion. In the example shown in FIG. 7, the tip end portions of the obverse-side shoulder portions 36*a* are formed such that a dimension thereof in the tape longitudinal direction is gradually increased from the body portion 33 toward the engaging head portion 35 and then the dimension thereof in the tape longitudinal direction is gradually decreased toward the tip end of the engaging head portion 35 in the tape width direction. That is, as illustrated in FIG. 7, the tip end portions of the obverse-side shoulder portions 36*a* in this embodiment are formed at a boundary position between a portion in which the dimension in the tape longitudinal direction is gradually increased and a portion in which the dimension in the tape longitudinal direction is gradually decreased. Also, in this embodiment, as illustrated in FIG. 7, the tip end portions of the pair of obverse-side shoulder portions 36*a* are disposed at a side of the engaging head portion 35 relative to the body portion 33 in the tape width direction. Since the tip end portion of the obverse-side shoulder portion 36*a* is disposed at the side of the engaging head portion 35, when the right and left fastener elements 31 are engaged to each other, it is suitable to withstand the pull-up.

Further, two concave accommodation grooves 37 for respectively accommodating two sewing yarns 25 is formed between the pair of the coupling yarns 22 so as to continue over the obverse side and both lateral sides of the body portion 33 and to be parallel with the coupling yarns 22. Accordingly, the two sewing yarns 25 are disposed between the pair of coupling yarns 22. Since the two sewing yarns 25 are respectively accommodated in the two accommodation grooves 37 of the fastener element 31, the two sewing yarns 25 are hardly released from the fastener element 31.

The pair of coupling yarns 22 has one coupling yarn for coupling the body portions 33 of the fastener elements 31 adjacent to each other in the longitudinal direction of the fastener tape 20 and coupling the side of the engaging head portion 35 of the respective body portions 33, and the other coupling yarn spaced apart from the one coupling yarn in the tape width direction for connecting the side of the respective body portions 33 spaced apart from the engaging head portion 35. Further, the coupling yarn 22 is thinner than the fastener element 31 in the obverse and reverse direction, and extends from the lateral side of the body portion 33 along the longitudinal direction of the fastener tape 20. The cross-sectional shape of the coupling yarn 22 is not limited to the circular shape, but a rectangular shape or an oval shape is possible.

The slider 40 includes, as illustrated in FIG. 1, a slider body 41, a pull tab attachment portion 42 formed on the slider body 41, and a pull tab 46 swingably attached to the pull tab attachment portion 42. When the pull tab 43 is pulled to move the slider 40 forward (toward the top end stop 11), the pair of right and left fastener elements 30 in the disengaged state are engaged to each other. When the pull tab 43 is pulled to move the slider backward (toward the bottom end stop 12), the pair of right and left fastener elements 30 in the engaged state are disengaged from each other.

As illustrated in FIG. 5, a dimension P in the tape longitudinal direction between centerlines CL of the plurality of fastener elements 31 in the tape longitudinal direction is set so that an interval dimension S between the adjacent body portions 33, 33 is appropriately ensured. The reason of such setting is as follows: if the interval dimension S is set to be small, it is difficult to sew the fastener elements 31 to the fastener tape 20; and when the pair of fastener element rows 30 are engaged to each other with the slider 40, the adjacent fastener elements 31 are brought into contact with each other, so that the fastener element 31 is not in a desired posture, which cannot ensure the smooth engagement.

As illustrated in FIG. 7, a dimension H of the engaging head portion 35 of the fastener element 31 in the tape longitudinal direction is set to be larger than a dimension L1 between the tip end portions of the pair of obverse-side shoulder portions 36*a* in the tape longitudinal direction.

In addition, the engaging head portion 35 of the body portion 33 on the reverse-side portion 32A is provided at lateral end portion thereof with a pair of reverse-side shoulder portions 33*c*. A dimension D between the pair of reverse-side shoulder portions 33*c* in the tape longitudinal direction is set to be smaller than the dimension L1 between the tip end portions of the pair of obverse-side shoulder portions 36*a* in the tape longitudinal direction. That is, the dimensions L1 is set to be larger than the dimension D.

Figure 8:
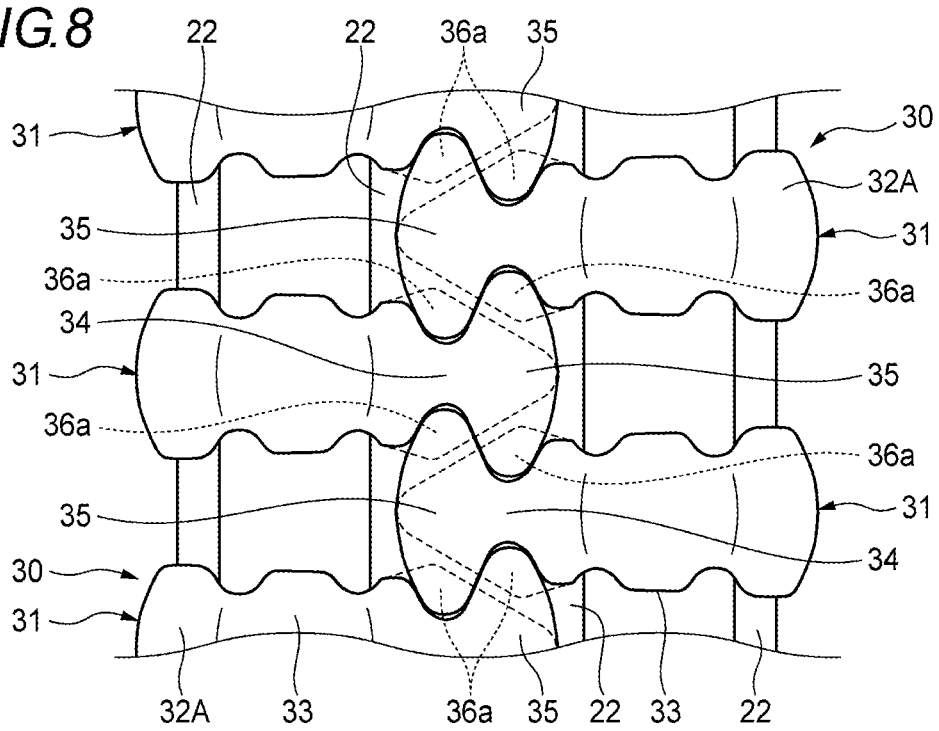
FIG. 8 is an enlarged rear side view illustrating a state in which the fastener element rows are normally engaged to each other.
Figure 9:
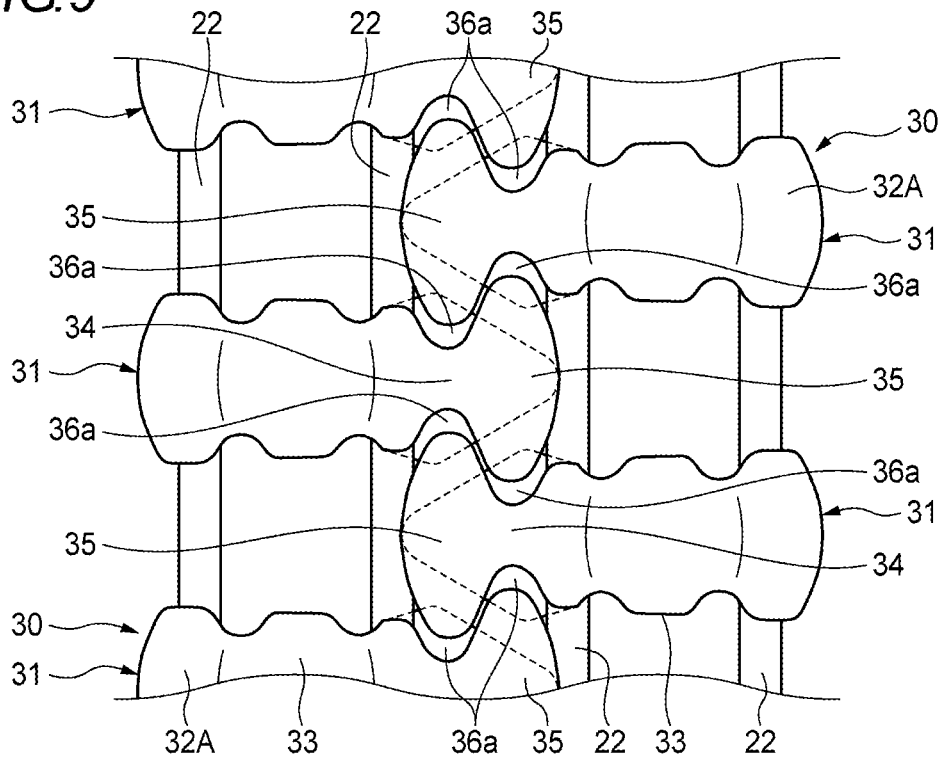
FIG. 9 is an enlarged rear side view illustrating the engaging state of the fastener element rows when the slide fastener is stretched.

In the slide fastener 10 including the above configuration, as illustrated in FIGS. 8 and 9, even though the slide fastener 10 is stretched in the tape longitudinal direction from a normal engaging state, since the dimension H of the engaging head portion 35 of the fastener element 31 in the tape longitudinal direction is set to be larger than the dimension L1 between the tip end portions of the pair of obverse-side shoulder portions 36*a* in the tape longitudinal direction, the engaging strength of the right and left fastener elements 31 is ensured, so that the engaging state of the pair of right and left fastener element rows 30 is reliably maintained.

As described above, according to the slide fastener 10 of this embodiment, each of the fastener elements 31 has the body portion 33 sewn to the fastener tape 20, the neck portion 34 extending from the body portion 33 in the tape width direction and in a direction toward the opposite fastener tape 20 and constricted in the tape longitudinal direction, the engaging head portion 35 further extending from the tip end portion of the neck portion 34 in the tape width direction and in the direction toward the opposite fastener tape 20 and swelling up in the tape longitudinal direction, the engaging head portion 35 being engageable with the opposite fastener elements 31, and the pair of obverse-side shoulder portions 36*a* which are provided at both sides of the neck portion 34 in the tape longitudinal direction, and configured to be in contact with the opposite engaging head portions 35 in the engaging state. Further, the pair of fastener tapes 20 have stretchability in the tape longitudinal direction. Thus, even though the slide fastener 10 is attached to the high-stretchable garment, it is possible to ensure the engaging strength of the fastener elements 31, thereby maintaining the engaging state of the pair of fastener elements 30.

According to the slider fastener 10 of this embodiment, the dimension H of the engaging head portion 35 in the tape longitudinal direction is set to be larger than the dimension L1 between the tip end portions of the pair of obverse-side shoulder portions 36*a* in the tape longitudinal direction. Thus, even when the slider fastener 10 is stretched, the engagement of the engaging head portions 35 can be ensured. Further, it is possible to withstand a so-called pull-up state in which a force in the tape obverse and reverse direction acts on the center portion of the right and left fastener elements 31 which are in the engaged state, in the tape width direction.

According to the slide fastener 10 of this embodiment, the obverse-side portion 32B has the obverse-side head portion 36 which extends from the body portion 33 in the tape width direction and in the direction toward the opposite fastener tape 20, of which a dimension in the tape longitudinal direction is gradually decreased toward the tip end portion thereof, so that the obverse-side head portion 36 is formed in the substantially triangular shape in a plan view. Accordingly, when the slide fastener 10 in the engaged state is bent toward the obverse side in the obverse and reverse direction, the adjacent fastener elements 31 are hardly in contact with each other, so that the slide fastener 10 can be easily bent.

Further, according to the slide fastener 10 in this embodiment, since the tip end portions of the pair of obverse-side shoulder portions 36*a* are disposed at a side of the engaging head portion 35 relative to the body portion 33 in the tape width direction, a large contact area between the obverse-side shoulder portion 36*a* and the opposite engaging head portion 35 can be ensured, thereby further withstanding the pull-up state.

Figure 10:
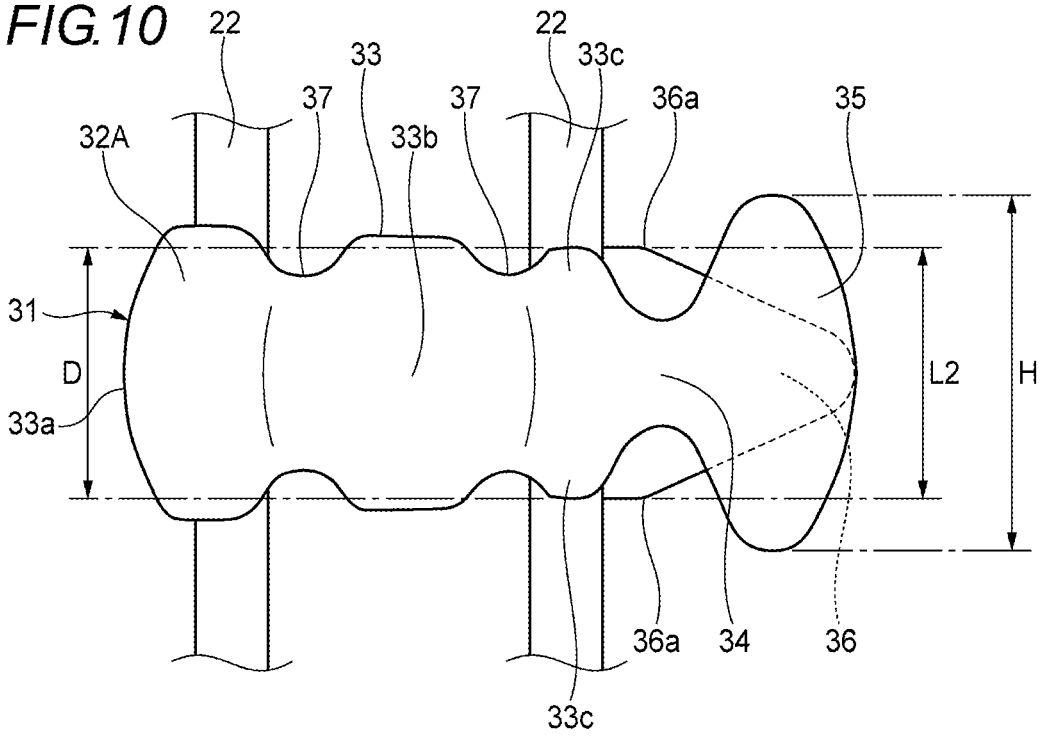
FIG. 10 is a rear side view illustrating a modification of the slide fastener according to the first embodiment.

As a modification of this embodiment, as illustrated in FIG. 10, the obverse-side shoulder portions 36*a* of the fastener element 31 at a side of the body portion 33 relative to the tip end portion may be formed in flat to be in parallel with the tape width direction, and a dimension L2 between the tip end portions of the pair of obverse-side shoulder portions 36*a* may be set to be smaller than the dimension L1 and to be substantially equal to the dimension D between the pair of reverse-side shoulder portions 33*c* in the tape longitudinal direction. In addition, as illustrated in FIG. 10, the dimension H of the engaging head portion 35 in the tape longitudinal direction is set to be larger than the dimension L2. Accordingly, since a protruding amount of the pair of obverse-side shoulder portions 36*a* in the tape longitudinal direction is reduced, it is possible to easily bend further the slide fastener 10. In the modification, the tip end portion of the obverse-side shoulder portion 36*a* is formed in parallel with the tape width direction, and the dimension thereof in the tape longitudinal direction is gradually decreased toward the tip end portion of the engaging head portion 35 in the tape width direction. That is, the tip end portion of the obverse-side shoulder portion 36*a* is formed at the boundary position between the parallel portion and the portion in which the dimension in the tape longitudinal direction is gradually decreased.

Embodiment 2

Next, a slide fastener according to the second embodiment of the present invention will now be described with reference to FIG. 11. In this instance, the same reference numerals are applied to the elements identical or equivalent to those in the first embodiment and the description thereof is omitted or simplified.

Figure 11:
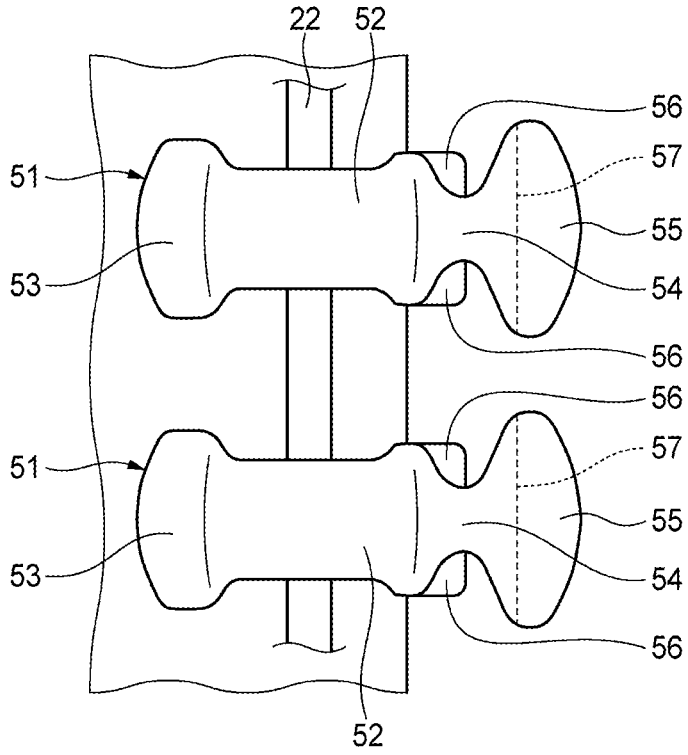
FIG. 11 is a front side view of the fastener element row to illustrate a second embodiment of the slide fastener according to the present invention.

In this embodiment, a fastener element 51 illustrated in FIG. 11 is used instead of the fastener element 31. The fastener element 51 is formed to have the same shape in the obverse and reverse sides. The fastener element 51 includes a body portion 53 formed with one wide accommodation groove 52 which is continuously formed on the obverse surface and both lateral sides to accommodate two sewing yarns 25, a neck portion 54 extending from the body portion 53 in the tape width direction and in a direction toward the opposite fastener tape 20 and constricted in the tape longitudinal direction, an engaging head portion 55 further extending from a tip end portion of the neck portion 54 in the tape width direction and in the direction toward the opposite fastener tape 20 and swelling up in the tape longitudinal direction, a pair of shoulder portions 56 formed at both sides of the neck portion 54 in the tape longitudinal direction, and a shoulder portion accommodating groove 57 formed at a tip end portion of the engaging head portion 55 and fitted with the shoulder portion 56 of the opposite fastener element 51. In this embodiment, one coupling yarn 22 is disposed at a substantially center portion of the body portion 53 in the tape width direction. In this instance, the fastener elements 51 are sewn to the fastener tape 20 by the two sewing yarns 25, like the fastener elements 31. Further, a dimension of the engaging head portion 55 in the tape longitudinal direction is set to be larger than a dimension between the pair of shoulder portions 56 in the tape longitudinal direction.

Other configurations and working effects thereof are identical to those of the first embodiment.

The present invention is not limited to the above-described embodiment, and can be properly modified or revised without being deviated from the gist of the invention.

For example, in the above embodiment, the reverse-side portion 32A of the fastener element 31 may be formed to have a flat surface, so that the curved portion 33*b* is not formed.

Further, the coupling yarn 22 may be made of a non-elastic yarn, so that the coupling yarn 22 is bent (remained) in accordance with the stretch of the fastener tape 20 when sewing to the fastener tape 20.

DESCRIPTION OF REFERENCE NUMERALS

10: Slide Fastener
20: Fastener Tape
20*a*: Tape Body Portion
20*b*: Tape-Side Edge Portion
22: Coupling Yarn
30: Fastener Element Row
31: Fastener Element
32A: Reverse-Side Portion (First Surface Portion)
32B: Obverse-Side Portion (Second Surface Portion)
33: Body Portion
34: Neck Portion
35: Engaging Head Portion
36: Obverse-Side Head Portion (Head Portion)
36*a*: Obverse-Side Shoulder Portion (Shoulder Portion)
40: Slider
H: Dimension of Engaging Head in Longitudinal Direction
L1: Dimension between Tip End Portions of Obverse-Side Shoulders in Tape Longitudinal Direction

The invention claimed is:

1. A slide fastener comprising:

a pair of fastener tapes;

a pair of fastener element rows respectively including a plurality of fastener elements arranged in a tape longitudinal direction along opposing tape-side edge portions of the pair of fastener tapes, and coupling yarns coupling the plurality of fastener elements which are adjacent to each other in the tape longitudinal direction, the fastener element rows respectively sewn to the tape-side edge portions; and a slider configured to engage and disengage the pair of fastener element rows, wherein each of the fastener elements includes:

a body portion sewn to the fastener tape;

a first surface portion which is in contact with the fastener tape and a second surface portion which is disposed at an opposite side of the fastener element;

a neck portion provided on the first surface portion which extends from the body portion in a tape width direction and in a direction toward an opposite fastener tape, and which is constricted in the tape longitudinal direction;

an engaging head portion provided on the first surface portion which extends from a tip end portion of the neck portion in the tape width direction and in a direction toward the opposite fastener tape and which further extends in the tape longitudinal direction, the engaging head portion being engageable with opposite fastener elements;

a pair of shoulder portions provided on the second surface portion which extends from the body portion in the tape longitudinal direction and which is configured to come in contact with opposite engaging head portions in an engaging state; and a head portion provided on the second surface portion which further extends from tip end portions of the pair of shoulder portions in a direction toward the opposite fastener tape, wherein a dimension of the head portion in the tape longitudinal direction gradually decreases toward a tip end thereof, wherein the pair of fastener tapes have stretchability in the tape longitudinal direction, and wherein a dimension of the engaging head portion in the tape longitudinal direction is set to be larger than a dimension between the tip end portions of the pair of shoulder portions in the tape longitudinal direction.

2. The slide fastener according to claim 1, wherein the coupling yarns have stretchability.

3. The slide fastener according to claim 1, wherein the tip end portions of the pair of shoulder portions are disposed on the second surface portion at a side of the engaging head portion relative to the body portion in the tape width direction.

4. The slide fastener according to claim 1, wherein surfaces of the pair of shoulder portions which are exposed on sides of the neck when viewed from the first surface portion side of the fastener element engage with surfaces of the opposite engaging head portions which are exposed on sides of the head portion when viewed from the second surface portion side of the fastener element.

* * * * *

UNITED STATES PATENT AND TRADEMARK OFFICE

CERTIFICATE OF CORRECTION

PATENT NO. : 9,237,782 B2
APPLICATION NO. : 13/824424
DATED : January 19, 2016
INVENTOR(S) : Zhiyu Ren It is certified that error appears in the above-identified patent and that said Letters Patent is hereby corrected as shown below:

On the Title Page (57), in column 2, in "Abstract", line 7, delete "head, portion" and insert -- head portion --, therefor.

Specification

In column 1, line 10, delete "strechability" and insert -- stretchability --, therefor.

In column 1, line 15, delete "strechability" and insert -- stretchability --, therefor.

In column 1, line 19, delete "strechability," and insert -- stretchability, --, therefor.

In column 1, line 20, delete "strechability" and insert -- stretchability --, therefor.

In column 1, line 23, delete "strechability" and insert -- stretchability --, therefor.

In column 1, line 42, delete "strechability," and insert -- stretchability, --, therefor.

In column 3, line 58, delete "strechability" and insert -- stretchability --, therefor.

In column 4, line 24, delete "strechability" and insert -- stretchability --, therefor.

In column 4, line 45, delete "strechability" and insert -- stretchability --, therefor.

In column 4, line 47, delete "kfg" and insert -- kgf --, therefor.

In column 4, line 48, delete "strechability" and insert -- stretchability --, therefor.

In column 4, line 50, delete "strechability" and insert -- stretchability --, therefor.

In column 4, line 58, delete "strechability" and insert -- stretchability --, therefor.

Signed and Sealed this
Twenty-sixth Day of April, 2016

Michelle K. Lee

Michelle K. Lee
*Director of the United States Patent and Trademark Office*